US009328478B2

(12) United States Patent
Filla et al.

(10) Patent No.: US 9,328,478 B2
(45) Date of Patent: May 3, 2016

(54) METHOD FOR CONTROLLING A WORKING MACHINE

(75) Inventors: Reno Filla, Eskilstuna (SE); Lennart Skogh, Eskilstuna (SE)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 14/240,413

(22) PCT Filed: Aug. 24, 2011

(86) PCT No.: PCT/KR2011/006240
§ 371 (c)(1),
(2), (4) Date: Feb. 27, 2014

(87) PCT Pub. No.: WO2013/027873
PCT Pub. Date: Feb. 28, 2013

(65) Prior Publication Data
US 2014/0207346 A1 Jul. 24, 2014

(51) Int. Cl.

| | |
|---|---|
| ***G06F 7/70*** | (2006.01) |
| ***E02F 3/43*** | (2006.01) |
| ***E02F 9/20*** | (2006.01) |
| ***E02F 9/22*** | (2006.01) |

(52) U.S. Cl.
CPC ..... *E02F 3/435* (2013.01); *E02F 3/431* (2013.01); *E02F 9/2029* (2013.01); *E02F 9/2079* (2013.01); *E02F 9/2246* (2013.01)

(58) Field of Classification Search
CPC ..... E02F 9/2025; E02F 9/2253; E02F 3/435
See application file for complete search history.

(56) References Cited

U.S. PATENT DOCUMENTS

| | | | | |
|---|---|---|---|---|
| 5,975,214 | A | 11/1999 | Okamura et al. | |
| 8,777,808 | B2 * | 7/2014 | Hyodo et al. | 477/54 |
| 2001/0056319 | A1 | 12/2001 | Rocke | |
| 2004/0117092 | A1 | 6/2004 | Budde | |
| 2006/0245896 | A1 | 11/2006 | Alshaer et al. | |

FOREIGN PATENT DOCUMENTS

| | | | |
|---|---|---|---|
| EP | 0270674 | A1 | 6/1988 |
| EP | 2211042 | A1 | 7/2010 |
| JP | 2011063945 | A | 3/2011 |
| WO | 9927196 | A1 | 6/1999 |
| WO | 2006098645 | A1 | 9/2006 |

OTHER PUBLICATIONS

International Search Report (Apr. 12, 2012) for corresponding International Application PCT/KR2011/006240.
International Preliminary Report on Patentability (Dec. 17, 2013) for corresponding International Application PCT/KR2011/006240.
European Search Report (Apr. 21, 2015) corresponding European App. EP 11 87 1225.

* cited by examiner

*Primary Examiner* — Michael D Lang
(74) *Attorney, Agent, or Firm* — WRB-IP LLP

(57) ABSTRACT

A method for controlling a working machine provided with a bucket as a work implement by which a lifting force can be exerted on an object such as a gravel pile, and at least one ground engaging element by which a traction force can be exerted on the same object is provided. A state input indicative of a current bucket state is received, the bucket height being a parameter of the current bucket state, determining a lifting force eliminating speed of the power source ("LFES") at the current bucket state, the LFES being the speed at and above which no lifting force could be achieved considering a reaction force acting on the bucket caused by the traction force, and the speed of the power source is controlled not to reach the LFES in order that at least some lifting force could be achieved.

19 Claims, 6 Drawing Sheets

METHOD FOR CONTROLLING A WORKING MACHINE

BACKGROUND AND SUMMARY

The present invention relates to a method, an electronic control unit, a vehicle control system, and a working machine for controlling a working machine having a bucket as a work implement. The term 'power source', which is described in the following text, is exemplified by an internal combustion engines such as a diesel engine. This should be regarded as a non-limiting example of such a power source.

Such a working machine as a wheel loader or a skid-steer loader is provided with a bucket as a work implement and at least one ground-engaging element such as wheels. The engine in the working machine is used for powering both the movement of the bucket via a hydraulic system and the movement of the machine via a traction system of the machine. Consequently, the operator is constantly challenged to balance the power given to the hydraulic system and the traction system by controlling the hydraulic levers (ex. lift and tilt levers of a wheel loader) and the gas pedal of the working machine. This is a general challenge for the operator of a working machine in which the engine is used for powering both the hydraulic system and the traction system.

A working machine is often used in a repeated work cycle. The term 'work cycle' comprises a route of the working machine and a movement of a work implement. For a working machine with a bucket such as a wheel loader, a short loading cycle is highly representative of the majority of applications. The archetype of the short loading cycle is bucket loading of a granular material such as gravel on an adjacent dump truck within a time frame of 25 to 35 seconds, which varies depending on how the work place is set up and how aggressively the operator uses the machine.

Including the short loading cycle, almost every work cycle of a wheel loader comprises a bucket filling phase during which the bucket is filled with granular material such as gravel of the gravel pile or any other objects that the wheel loader works with.

In order to fill the bucket with granular material, the operator needs to control three motions simultaneously: a forward motion of the wheel loader to penetrate into the gravel pile (traction), an upward motion of the bucket (lift) and a rotating motion of the bucket to fit in with as much granular material as possible (tilt). This is similar to how a simple manual shovel is used. However, in contrast to a manual shovel, these three motions cannot be directly controlled by the operator of a wheel loader, in spite of being observed. Instead, the operator has to use different subsystems of the machine in order to accomplish the task. The gas pedal controls the traction system, while the lift and tilt levers control the hydraulic system to yield lifting and tilting motions of the bucket.

During a bucket filling phase, the general challenge of balancing the hydraulic system and the traction system by controlling the gas pedal and hydraulic levers becomes more complicated. This is because the power delivered to the traction system does not only decrease the remaining power usable for the hydraulic system, but also directly prevent the lifting motion of the bucket due to a strong interaction between the forces originating from the two systems.

Penetrating the gravel pile with the bucket requires the traction force exerted by the bucket, which is originating from the traction system. When the bucket is about to be filled with gravel from the gravel pile, the bucket is physically connected to the ground, since the gravel pile is stuck to the ground. Due to this fact, the traction force creates a reaction force acting on the bucket in accordance with Newton's Third Law of Motion, the Law of Reciprocal Actions, and the reaction force acts to cancel out the lifting force originating from the hydraulic system.

Due to the fact that the force from the hydraulic system is cancelled out by traction in such a manner during the bucket pilling phase, the traction force must be carefully applied and the operator should reduce the traction force when the bucket is stuck in the gravel pile. However, when having the bucket stuck in the gravel pile and the lifting effort goes in vain, the obvious reaction for the operator would be to push the gas pedal more deeply in order to get more engine speed and thus "make the machine stronger". However, this will just make the situation worse: more traction force will be created, which counteracts the lifting effort even more and the working machine consumes fuel without any useful work. Actually, the operator must do the counter-intuitive thing and lighten up on the throttle in order to reduce the engine speed.

The fact that the lifting force is cancelled out by traction in such a manner and the operator must do the counter-intuitive thing during the bucket filling phase yields several problems.

The working machine will be experienced as a weak machine and a machine of poor operability by the operator, especially by an inexperienced one, who will have a negative impression accordingly.

As the operability is poor, the operator will not be able to operate the machine in a productive, yet fuel-efficient manner. This poor operability and lack of fuel efficiency are not the problems pertaining only to inexperienced operators. The bucket can sometimes be stuck in the gravel pile even when the machine is operated by an experienced operator. In that case, of course, the experienced operator will get out of the situation more quickly with proper operation compared to other inexperienced operators. However, the unnecessary fuel consumption due to the situation that the bucket is stuck in the gravel pile is unavoidable.

In this regard, FIG. 1 illustrates fuel consumption during a short loading cycle of a conventional wheel loader driven by an experienced operator. The test results show that the fuel consumption rate (FC rate) is approximately 60% higher during the bucket filling phase than the cycle average (mean FC rate). Expressed in absolute values, the bucket filling accounts for 35~40% of the mean total fuel consumption per cycle, yet the time spent for filling the bucket is only 25% of the average cycle time. Through FIG. 1 showing the fuel consumption during the operation by an experienced operator, it is understandable that more fuel will be consumed during the bucket filling phase when the machine is operated by an inexperienced operator.

Accordingly, when considering the problems related to the bucket filling phase and the results from FIG. 1 showing that the fuel efficiency is relatively low during the bucket filling phase, no matter whether the operator is skillful or not, there is a need to enhance fuel and work efficiencies by looking closely at the bucket filling phase.

The present invention was designed according to the necessity of an in-depth analysis of the bucket filling phase for the improvement of fuel efficiency and operational convenience. It is desirable to make a working machine operated in a productive, yet fuel-efficient manner by increasing its efficiency for easy operation even by inexperienced operators and by preventing unnecessary fuel consumption during the bucket filling phase.

According to an aspect of the present invention, a method is provided for controlling a working machine provided with a bucket as a work implement by which a lifting force can be exerted on an object such as a gravel pile, and at least one ground engaging element by which a traction force can be exerted on the same object, wherein the lifting force is an upward-directed lifting force experienced by the object. The method comprises the steps of:

receiving a state input indicative of a current bucket state, a bucket height being a parameter of the current bucket state, determining a lifting force eliminating speed of a power source (LFES) at the current bucket state, the LFES being the speed at and above which no lifting force could be achieved considering a reaction force acting on the bucket caused by the traction force, and controlling the speed of the power source not to reach the LFES in order that at least some lifting force could be achieved.

An aspect of the present invention also relates to an electronic control unit (ECU) being adapted to perform any of the method steps according to the method. Furthermore, an aspect of the present invention relates to a vehicle control system comprising the ECU, and a working machine comprising the vehicle control system.

According to another aspect of the present invention, a method is provided for controlling a working machine provided with a bucket as a work implement by which a lifting force can be exerted on an object such as a gravel pile, and at least one ground engaging element driven by one or a plurality of electric or hydrostatic wheel motors by which a traction force can be exerted on the same object, wherein the lifting force is an upward-directed lifting force experienced by the object. The method comprises the steps of:

receiving a state input indicative of a current bucket state, a bucket height being a parameter of the current bucket state, determining a lifting force eliminating torque of the wheel motor(s) (LFET) at the current bucket state, the LFET being the torque at and above which no lifting force could be achieved considering a reaction force acting on the bucket caused by the traction force, and controlling the torque of the wheel motor(s) not to reach the LFET in order that at least some lifting force could be achieved.

Advantageous Effects of Invention

The main advantage with an aspect of the present invention is that even inexperienced operators can operate a working machine more easily by preventing the lifting force from being totally cancelled out by the reaction force and making it achieved through the control of the engine speed according to the bucket state.

Another advantage of the present invention is that a working machine can be operated in a productive, yet fuel-efficient manner by eliminating unnecessary fuel consumption related to the bucket being stuck in the gravel pile and accordingly increasing the efficiency of the working machine during the bucket filling phase.

Other preferred embodiments and advantages of the invention will emerge from the detailed description below.

BRIEF DESCRIPTION OF DRAWINGS

In the following text, the invention will be described in detail with reference to the attached drawings. These drawings are used for illustration only and do not in any way limit the scope of the invention.

TERMS FOR DRAWING REFERENCE NUMERALS

Figure 1:
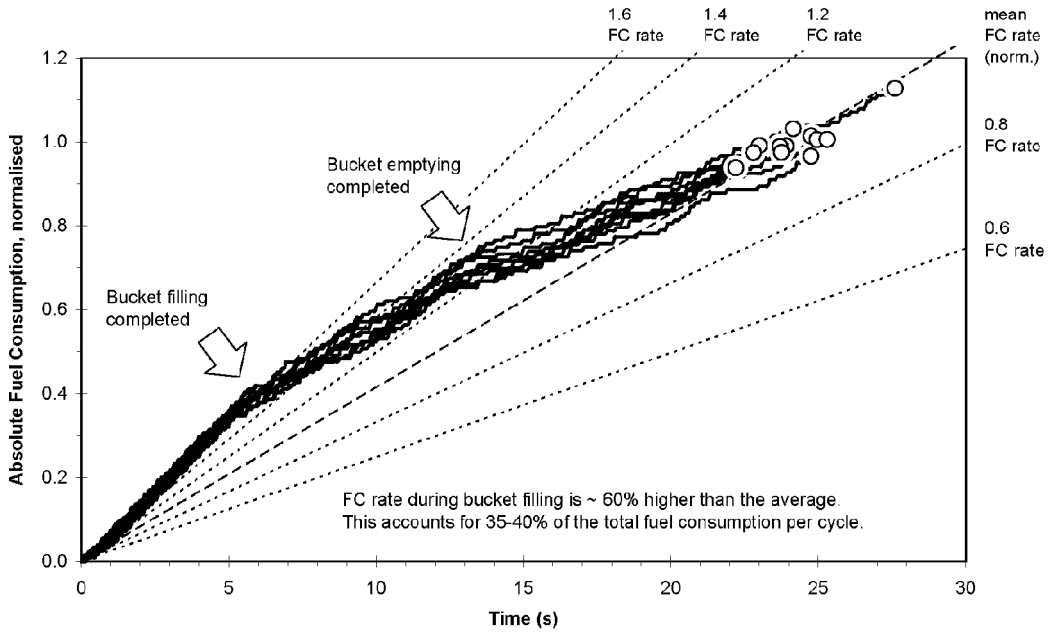
FIG. 1 illustrates fuel consumption during a short loading cycle of a conventional wheel loader driven by an experienced operator.

100: Wheel loader 110: Handling equipment
120: Load arm 121: Rotating axis
125: Lift cylinder 130: Bucket
131: Height sensor 132: Angle sensor
133: Inclination sensor 135: Engine
136: Traction system 137: Hydraulic system
140: Wheel 150: ECU
200: Traction force 300: Lifting force

DETAILED DESCRIPTION

The invention will now be described in detail with reference to the preferred embodiments of the invention and the drawings. The embodiments of the invention with further developments described in the following are to be regarded only as examples and are in no way to limit the scope of the protection provided by the patent claims.

The invention relates to a method, an electronic control unit, a vehicle control system, and a working machine for controlling a working machine having a bucket as a work implement by which a lifting force can be exerted on an object such as a gravel pile, and at least one ground engaging element by which a traction force can be exerted on the same object, wherein the lifting force is an upward-directed lifting force experienced by the object. The power source of the working machine will be exemplified in the following by an internal combustion engine.

The electronic control unit, the vehicle control system, and the working machine are adapted to perform the method steps as described in the method according to the embodiments described herein. It should therefore be understood by a person skilled in the art that the fact the electronic control unit, the vehicle control system, and the working machine perform the method steps means that the method embodiments also include the electronic control unit, the vehicle control system, and the working machine, even though these are not described in detail herein.

Figure 2:
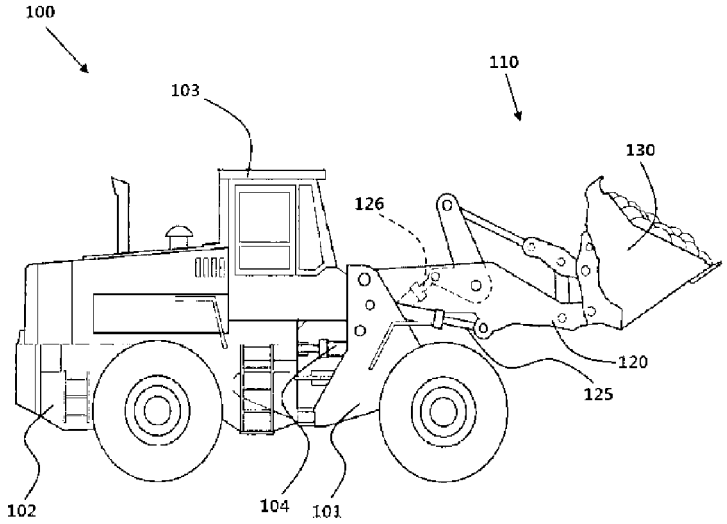
FIG. 2 schematically shows a wheel loader in a side view.

FIG. 2 shows an example of the wheel loader (100) according to the present invention. The body of the wheel loader (100) comprises a front body section (101) and a rear body section (102). The rear body section (102) comprises a cab (103). The body sections (101, 102) are connected to each other in such a way that they can pivot. A pair of steering cylinders (104) is provided for steering the wheel loader (100). The wheel loader comprises an equipment (110) for handling objects or material. The equipment (110) comprises a load arm (120) and a bucket (130) as a work implement fitted to the load arm (120). The bucket (130) is an example of a work implement and may be replaced with a fork or a log grapple. One end of the load arm (120) is pivotally connected to the front body section (101). The bucket (130) is connected to the other end of the load arm (120).

The load arm (120) can be raised and lowered relative to the front body section (101) by means of two lift cylinders (125), each of which is connected at one end to the front body section (101) and at the other end to the load arm (120). The bucket (130) can be tilted relative to the load arm (120) by means of a tilt cylinder (126) which is connected at one end to the front body section (101) and at the other end to the bucket (130) via a link-arm system.

Figure 3:
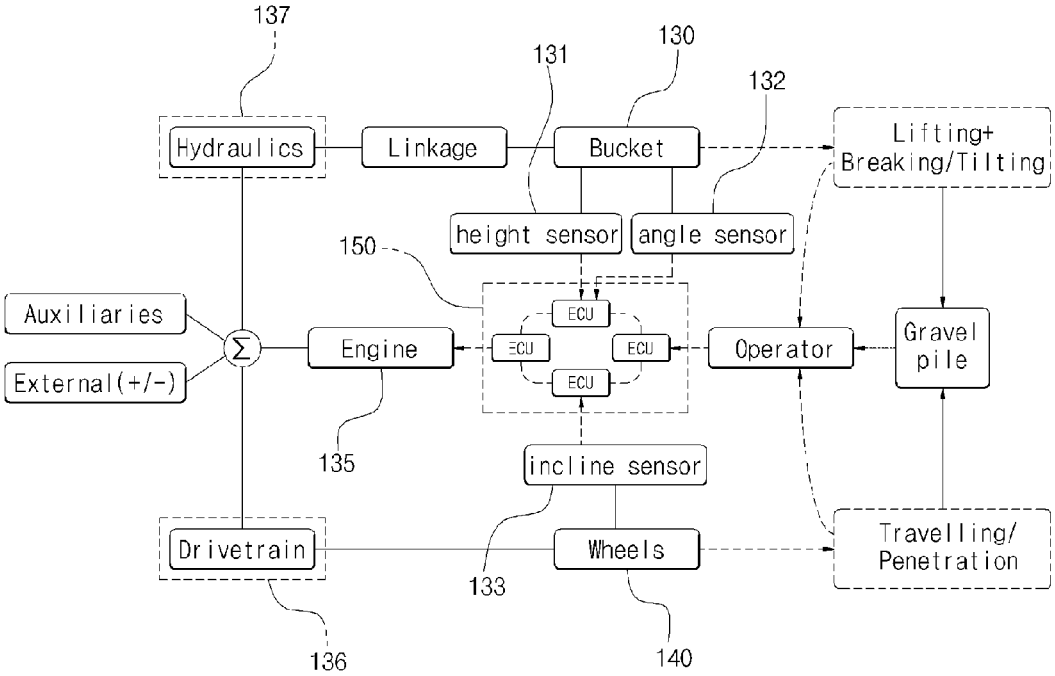
FIG. 3 illustrates a wheel loader comprising a vehicle control system of an embodiment of the present invention.

FIG. 3, illustrating a wheel loader comprising a vehicle control system of an embodiment of the present invention, also illustrates how the hydraulic system (136) and the traction system (137) are coupled in a working machine such as a wheel loader (100). As illustrated, the engine (135) power is fed to both systems (136, 137).

The hydraulic system (136) comprises hydraulic pumps, hydraulic valves, and hydraulic cylinders (104, 125, 126). At least one hydraulic pump driven by the engine (135) supplies the hydraulic cylinders (104, 125, 126) with the hydraulic fluid. In electro-hydraulic systems the ECU (150) is coupled with a number of electric operator levers such as lift and tilt levers arranged in the cab (103) to receive electric control input from the levers. A number of electrically controlled hydraulic valves in the hydraulic system (136) are electrically connected to the ECU (150) and hydraulically connected to the cylinders (104, 125, 126) for regulating the work of these cylinders. In conventional hydraulic systems the lift and tilt lever are hydraulically connected to the valves and aforementioned cylinders. The present invention works for both types of hydraulic systems.

In FIG. 3, the hydraulic pumps, cylinders, and the valves are not indicated with reference numerals but the hydraulic system (136) includes them.

The traction system (137) operates a working machine such as a wheel loader (100) on the ground.

In traction systems of a conventional working machine, the traction system (137) comprises a torque converter and transmission axles. The power from the torque converter is fed via the transmission axles to the ground engaging element such as wheels (140). Since the wheels (140) act on the ground through travelling and penetration, there will be a traction force coupling between the engine (135) and the ground. The ECU (150) controls the engine (135) on the basis of operator control input created when the operator pushes the gas pedal. Other means replacing the gas pedal, such as a button, lever or touch screen, may also be used. Other elements in FIG. 3 will be explained later. The traction force can be controlled by controlling the engine for the conventional traction systems. In traction systems featuring one or a plurality of electric or hydrostatic wheel motors, the traction force can be directly controlled by controlling the torque of said wheel motor(s). Such traction systems can for example be employed in a hybrid-electric working machine, but not exclusively.

In the preferred embodiments, the description of a conventional working machine is likewise applied to a working machine with wheel motors, except the difference on what controls the traction force, i.e., the speed of the engine or the torque of the wheel motor(s). Accordingly, for convenience' sake, the description hereinafter will be based on a conventional working machine equipped with conventional traction systems except in the case of requiring aforesaid differentiation.

As can be seen from FIG. 3, the engine (135) is used for powering both the hydraulic system (136) and the traction system (137). Consequently, the operator is constantly challenged to balance the power given to the hydraulic system and the traction system by controlling the hydraulic levers (ex. lift and tilt levers) and the gas pedal of the working machine. This is a general challenge for the operator of a working machine in which the engine is used for powering both the hydraulic system and the traction system.

Figure 4:
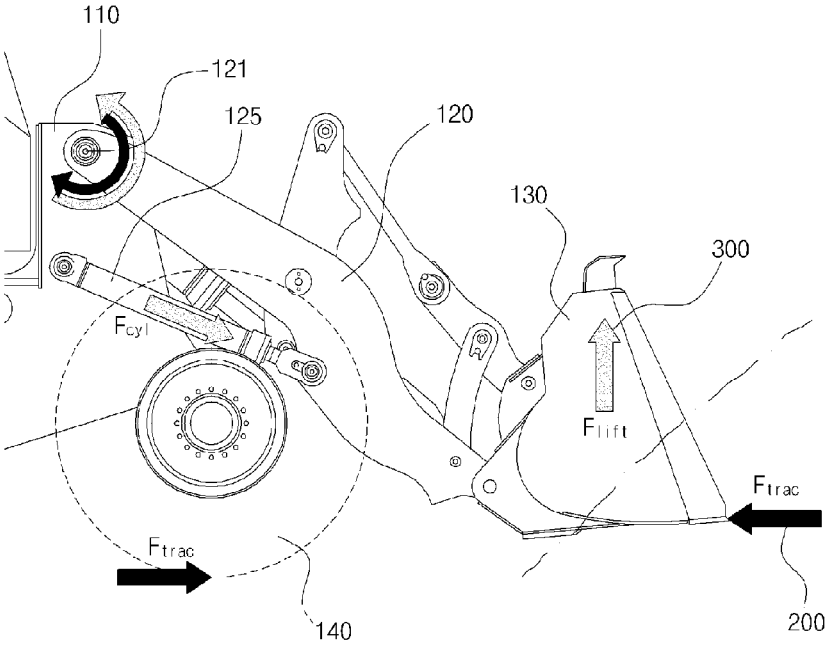
FIG. 4 illustrates how the traction force and the lifting force act during the bucket filling phase.

Further, there is a strong force coupling via both systems especially during the bucket filling phase. This is illustrated in FIG. 4. The lift cylinders (125) create hydraulic forces (Fcyl) when the hydraulic system (136) increases the hydraulic flow in the cylinders (125). The lift cylinders (125) are linked to the load arm (120) at a certain distance from the rotating axis (121) of the load arm (120). Thereby a counter-clockwise moment around the rotating axis (121) is created and consequently a lifting force is achieved. The gravel pile, which is influenced by the bucket (130), will experience this as an upward-directed lifting force (Flift) (300). That is, the lifting force (300) is exerted vertically from the bucket (130) and the lifting force (300) is used to lift the bucket out of the gravel pile.

However, the lifting force (300) is influenced not only by the hydraulic forces, but also by the traction force (Ftrac). The traction force (Ftrac) originating from the engine (135) and transmitted through the torque converter and the transmission to the axles, is further transmitted to the bucket (130) via the traction force coupling between the wheels (140) and the ground. When the bucket is about to be filled with gravel from the gravel pile, the bucket (130) is physically connected to the ground, since the gravel pile is stuck to the ground. Due to this fact, the traction creates a reaction force (200) acting on the bucket (130) by the gravel pile in accordance with Newton's Third Law of Motion, the Law of Reciprocal Actions, and the reaction force (200) creates a clockwise moment around the rotating axis (121) of the load arm (120) which counteracts the lifting moment created by the hydraulic system (136), and acts as a factor decreasing the lifting force (300).

That is, the hydraulic forces (Fcyl) exerted to the bucket (130) by the lift cylinders (125) create a counter-clockwise moment around the rotating axis (121) as illustrated in FIG. 4, and if no additional force is exerted to the bucket (130), the whole counter-clockwise moment will be converted into the lifting force (300). However, the reaction force (200) acting on the bucket (130) creates a clockwise moment around the rotating axis (121), and thus the lifting force (300) created by the hydraulic system (136) is cancelled out or reduced.

The degrading effect of the traction force to the lifting force is linearly dependent on the traction force's magnitude and its point of attack, as the degrading effect is related to the counteracting moment around the rotating axis (121). The point of attack is influenced mainly by the bucket height.

Figure 5:
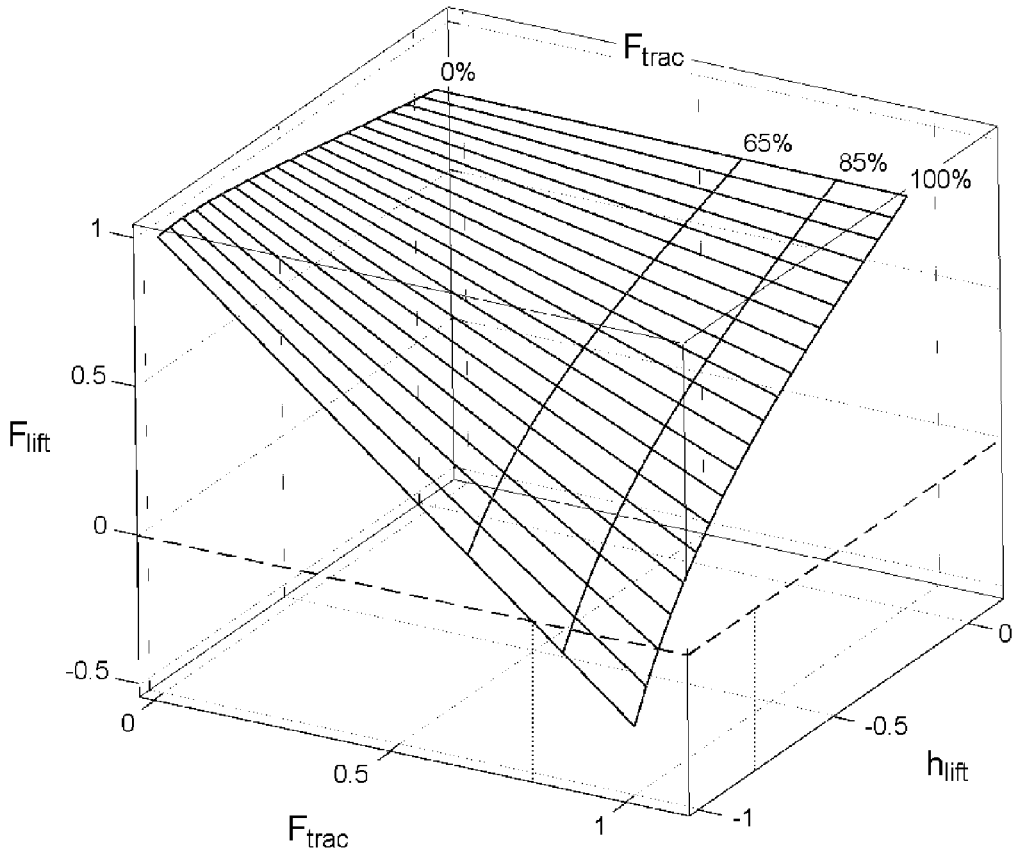
FIG. 5 illustrates the dependency between the traction force, the lifting force, and the bucket height of a wheel loader.

FIG. 5 illustrates the dependency between the traction force, the lifting force (300), and the bucket height of a wheel loader. In this graph, values of the traction force (Ftrac) (the same as the reaction force (200)), the lifting force (Flift), and the bucket height (hlift) are normalized. Here, the lifting force (Flift) is the maximum lifting force which could be achieved under the condition of the traction force and the bucket height.

In FIG. 5, the bucket height is "0" when the arm (120) is parallel to the ground, i.e., the point of attack of the traction force is at the same height as the rotating axis (121), and the bucket height is "−1" when the bucket (130) is at the lowest possible position. When the bucket height is higher than the height of the rotating axis (121), the traction force does not create any counteracting moment, and thus such a case does not need to be considered at all.

It can be recognized that, when the bucket height is near the value of "0", the lifting force could be achieved for all values of the traction force and not substantially decreased even though the traction force is increased. However, when the bucket height is near the value of "−1", the lifting force (which is the maximum achievable lifting force) is substantially decreased as the traction force is increased, and no lifting force could be achieved from some traction force. For example, as can be seen, at the lowest possible bucket height (hlift=−1), all traction force above 70% of the maximum traction (Ftract=0.7) will counteract the lifting effort, so that no upward lifting force can be exerted (Flift≤0). As the bucket itself is stuck in the gravel pile, it cannot be moved further neither by pushing the gas pedal nor by using the lift lever. Therefore, in order to accomplish the purpose of the present invention, the maximum permissible limit of the traction force should be controlled according to the bucket height.

As mentioned previously, in traction systems featuring one or a plurality of electric or hydrostatic wheel motors, the traction force can be directly controlled by controlling the torque of said wheel motor(s).

Figure 6:
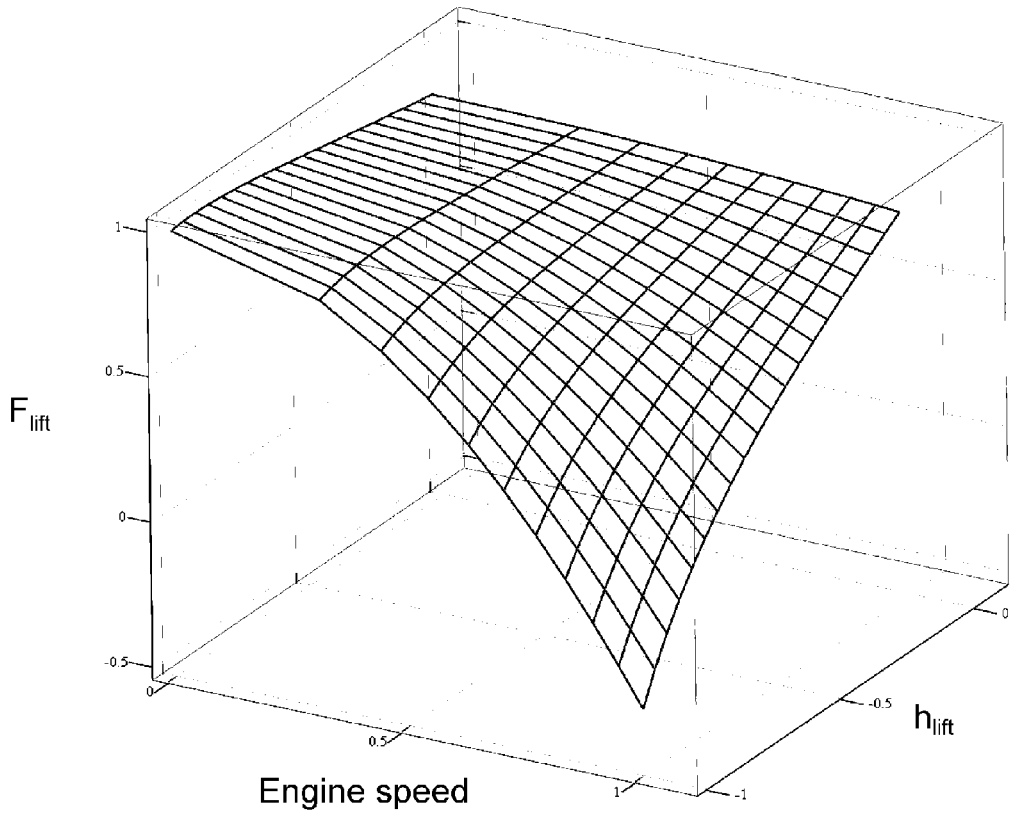
FIG. 6 illustrates the dependency between the engine speed, the lifting force, and the bucket height of the wheel loader of FIG. 5.

Meanwhile, in conventional traction systems, the traction force is a function of the engine speed. It is generally known that output torque from a torque converter at a fixed speed ratio is quadratically proportional to the input speed. Therefore, the traction force is quadratically proportional to the engine speed, provided the torque converter speed ration is constant. FIG. 6 illustrates the dependency between the engine speed, the lifting force, and the bucket height of the wheel loader of FIG. 5. The similarity between FIGS. 5 and 6 is caused by the proportional relation between the traction force and the engine speed. According to the same logic as the one demonstrated in the description for FIG. 5, it is obvious that the control over the maximum permissible limit of the engine speed according to the bucket height is needed for the achievement of the purpose of the present invention.

Figure 7:
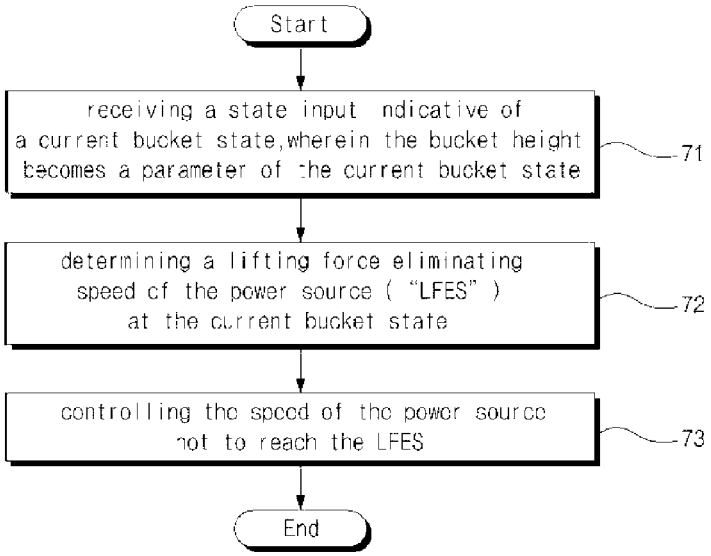
FIG. 7 illustrates the method according to the present invention.

Consequently, as described in FIG. 7 showing the method of the present invention, the first step (71) is to receive a state input indicative of a current bucket state, wherein the bucket height becomes a parameter of the current bucket state.

The bucket state can be defined as one of several types of geometrical parameters affecting the lifting force, and the most basic parameter is the bucket height as described above regarding FIGS. 5 and 6. The bucket height is a parameter to determine where the bucket is located between the lowest possible position and the height of the rotating axis (121).

The state input corresponding to the parameter of the bucket height can be created by various ways. Some of those ways include detecting the length (stroke) of the lift cylinder (125), sensing the angle of the load arm (120), and directly measuring the height of the bucket. A height sensor (131) creating the state input corresponding to the parameter of the bucket height by using the one chosen among the above various ways is illustrated in FIG. 3. The ECU (150) determines a current bucket height by receiving the state input corresponding to the parameter of the bucket height from the height sensor (131).

It is advisable to set, in addition to the bucket height, the bucket angle as an additional parameter of the current bucket state. As already described, the degrading effect of the traction force to the lifting force is linearly dependent on the traction force's magnitude and its point of attack, as the degrading effect is related to the counteracting moment around the rotating axis (121). Here, although the point of attack is mainly influenced by the bucket height, the bucket angle also influences the point of attack. The bucket angle indicates the degree to which the bucket is tilted due to the operation of the tilt cylinder (126), etc.

The state input corresponding to the parameter of the bucket angle can be created by various ways. Some of those ways include detecting the length (stroke) of the tilt cylinder (126), sensing the angle of one of the link-arms (e.g. the bellcrank) related to the tilt cylinder (126), and directly measuring the angle of the bucket. An angle sensor (132) creating the state input corresponding to the parameter of the bucket angle by using the one chosen among the above various ways is illustrated in FIG. 3. The ECU (150) determines a current bucket angle by receiving the state input corresponding to the parameter of the bucket angle from the angle sensor (132).

As the inclination of the ground on which the wheel loader (100) is working also affects the lifting force, it is advisable to set the vehicle inclination angle as an additional parameter of the current bucket state. As already said, the degrading effect of the traction force to the lifting force is linearly dependent on the traction force's magnitude and its point of attack, as the degrading effect is related to the counteracting moment around the rotating axis (121). To be exact, the traction force here means the reaction force. When the wheel loader is operating on the flat ground, the reaction force is equal to the traction force originating from the engine. However, if the workplace is sloping, the reaction force is not equal to (i.e., less than or greater than) the traction force originating from the engine, and the lifting force affected by the reaction force varies accordingly. Therefore, it is advisable to add a vehicle inclination angle to the list of parameters for considering that the reaction force and the traction force originating from the engine are not equal to each other.

Figure 8:
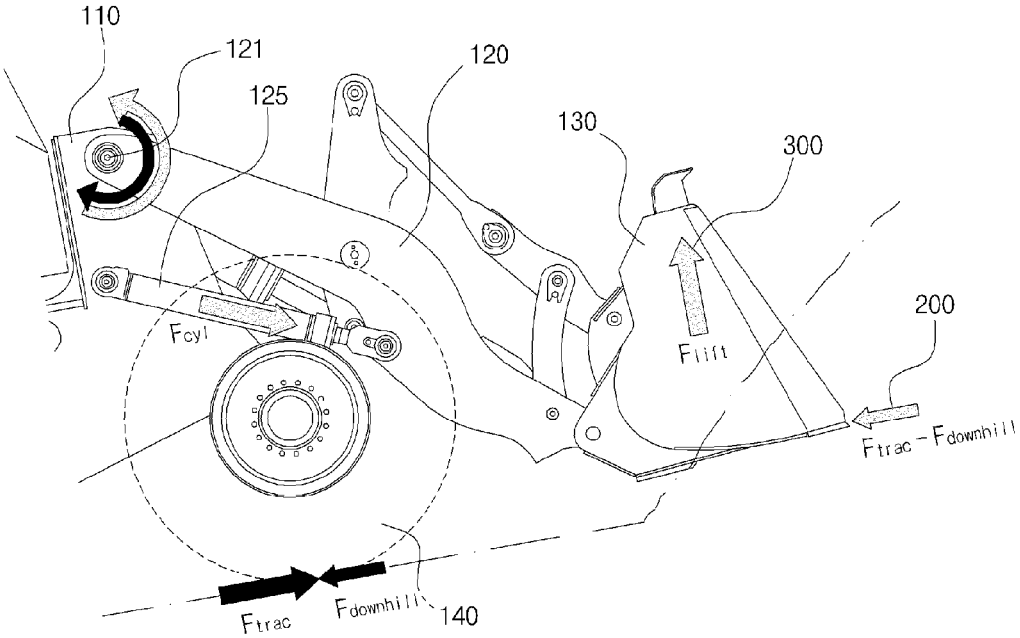
FIG. 8 illustrates the relationship of forces acting during the bucket filling phase on an inclined surface.
Figure 9:
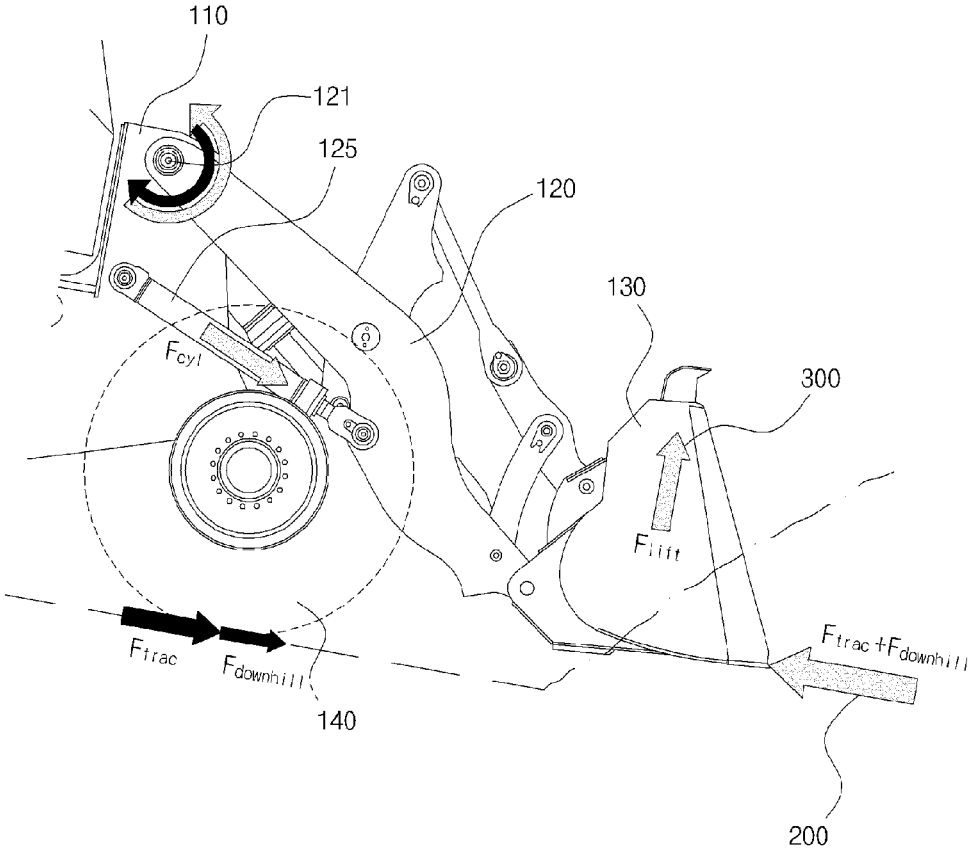
FIG. 9 illustrates the relationship of forces acting during the bucket filling phase on a declined surface.

FIGS. 8 and 9 illustrate that the reaction force exerted on the bucket varies according to the vehicle inclination angle even when the traction forces originating from the engine are the same.

When the wheel loader (100) is operating on an ascent surface as shown in FIG. 8, a downhill force backward is exerted due to the vehicle's weight. The downhill force which is exerted on the wheels (140) counter-acts the aggregated traction force delivered from the engine to the wheels, resulting in the decrease of the reaction force exerted on the bucket (130). Thus, as the reaction force exerted on the bucket becomes smaller than the traction force delivered from the engine, the maximum permissible limit of the engine speed for achieving at least some lifting force at an ascent slope should be larger than that which can be allowed on the flat ground.

On the contrary, when the wheel loader (100) is operating on a descent surface, a downhill force forward is exerted due to the vehicle's weight. The downhill force adds to the aggregated traction force delivered from the engine to the wheels, resulting in the increase of the reaction force exerted on the bucket (130). Thus, as the reaction force exerted on the bucket becomes greater than the traction force delivered from the engine, the maximum permissible limit of the engine speed for achieving at least some lifting force at a descent slope should be smaller than that which can be allowed on the flat ground.

The state input corresponding to the parameter of the vehicle inclination angle can also be created by various ways, and an inclination sensor (133) creating the state input corresponding to the parameter of the vehicle inclination angle is illustrated in FIG. 3. The ECU (150) determines a current vehicle inclination angle by receiving the state input corresponding to the parameter of the vehicle inclination angle from the inclination sensor (133).

As illustrated in FIG. 7, for a conventional working machine, the second step (72) in the method of the present invention is to determine a lifting force eliminating speed of the power source (LFES) at the current bucket state. Here, the LFES is the speed at and above which no lifting force could be achieved considering a reaction force acting on the bucket caused by the traction force.

For instance, let's assume that the bucket height (hlift) is the only parameter defining a bucket state and there is a wheel loader (100) wherein the relation among the bucket state, the traction force (or the engine speed), and the achievable lifting force corresponds to those illustrated in FIGS. 5 and 6. If the entered value for the bucket state is −1 (i.e., hlift=−1), since all traction force equal to or above 70% of the maximum traction (Ftract=0.7) will eliminate the achievable lifting force as shown in FIG. 5, the engine speed corresponding to Ftract=0.7 is set as the LFES for the current bucket state.

If a parameter comprising the bucket state is added, the graph or the relational expression showing the correlation among the bucket state, the engine speed, and the lifting force would be more complicated than those in the case of FIG. 6 wherein there is only one parameter, i.e., the bucket height, but there is no essential difference.

In the present invention, the ECU (150) may determine the LFES for the current bucket state in order to guarantee an easy bucket filling.

The ECU (150) can solve equations in real time to determine the LFES for the current bucket state. The equations may include the equations for balance of moments and balance of forces.

Figure 10:
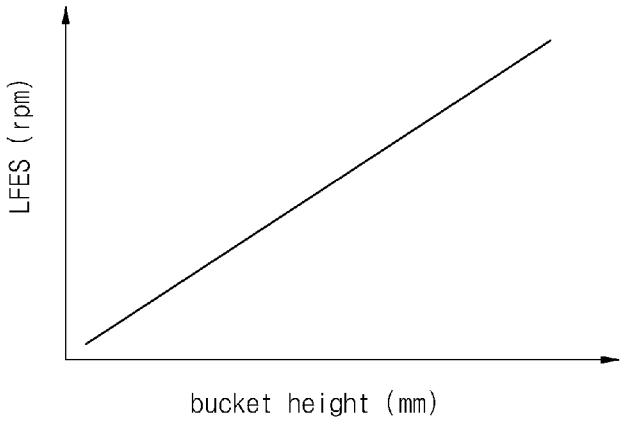
FIG. 10 illustrates one specific example of the mapping of the relationship between the lifting force eliminating speed and the bucket height of a wheel loader utilizing the method of an embodiment of the present invention.

Also, a pre-calculated table which contains the LFES for each bucket state can be made, as shown in an example in FIG. 10, and then the ECU (150) determines the LFES from the table.

FIG. 10 shows an example of the mapping of the relationship between the LEFS and the bucket height of a wheel loader utilizing the method of an embodiment of the present invention. In this figure, the relationship is linear, but this is only one example. It must be pointed out that a torque converter with other characteristics will lead to a non-linear relationship between the bucket height and the LEFS.

FIG. 10 illustrates the case where the bucket height is only considered, but it is possible to determine the LFES through a three-dimensional lookup table containing each LFES corresponding each bucket height and each bucket angle.

If the vehicle inclination angle is considered together, the lookup table now also has values for typical inclinations, for example, in steps of 5 degree from −30 degrees to +30 degrees vehicle inclination angle. Then the ECU (150) interpolates to get the LFES corresponding to other angle.

For a working machine with wheel motors, the second step in the method of the present invention is to determine a lifting force eliminating torque of the wheel motor(s)(LFET) at the current bucket state. Here, the LFET is the torque at and above which no lifting force could be achieved considering a reaction force acting on the bucket caused by the traction force.

As illustrated in FIG. 7, the last step in the method of the present invention is to control the speed of the power source not to reach the LFES. By doing so, at least some lifting force could be achieved.

For a working machine with wheel motors, the last step in the method of the present invention is to control the torque of the wheel motor(s) not to reach the LFET. By doing so, at least some lifting force could be achieved.

Each step described above can be also accomplished using a traction force limitation controller in addition to the ECU (150), whose case is deservedly included in the scope of the present invention. In the detailed description of the invention, it is explained that each step described above is progressed through the ECU (150) is capable of performing such basic tasks as controlling engines, and also at the last step, the ECU (150) controls engines to prevent the engine speed from exceeding the LFES. Meanwhile, the ECU (150) is included in the vehicle control system as shown in FIG. 3.

Additionally, even though it is possible to always apply the method of the present invention to a working machine, it is advisable to control the engine speed not to exceed the LFES only during the bucket filling phase by detecting and recognizing whether the working machine is currently in the bucket filling phase.

One way to recognize whether the working machine is in the bucket filling phase is to provide a mode switch for activating such bucket filling phase and detect whether the mode switch is operated. By doing so, the operator can freely choose between an assisted mode and an unassisted mode.

Also, the bucket filling phase can be figured out by using a pre-set standard for the input, including one or more of the following states: the bucket height, the bucket angle, and the speed of a working machine. By using a statistical standard after collecting the state inputs typically shown in the relevant bucket filling phase of a working machine, it is possible to exactly perceive the bucket filling phase within the margin of error, and the operator can operate a working machine under a current optimal condition without having to operate the mode switch. Also, a manual override switch can be provided. When this manual override switch is activated, the engine speed control of the present invention is released even when the engine is properly controlled during the bucket filling phase. This is because some experienced operators sometimes prefer to manually operate a working machine by themselves.

INDUSTRIAL APPLICABILITY

The present invention provides a method, an electronic control unit, a vehicle control system, and a working machine for controlling a working machine having a bucket as a work implement. Engine speed is controlled not to reach the LFES of the current bucket state which comprises the bucket height, the bucket angle, and the vehicle inclination angle, and there could be some lifting force always and operability of the working machine greatly enhanced.

The invention claimed is:

1. A method for controlling a working machine provided with a bucket as a work implement by which a lifting force can be exerted on an object such as a gravel pile, and at least one ground engaging element by which a traction force can be exerted on the same object, wherein the lifting force is an upward-directed lifting force experienced by the object, comprising:

receiving a state input indicative of a current bucket state, a bucket height being a parameter of the current bucket state, determining a lifting force eliminating, speed of a power source (LFES) at the current bucket state, the LFES being the speed at and above which no lifting force could be achieved considering, a reaction force acting on the bucket caused by the traction force, and controlling the speed of the power source not to reach the LFES in order that at least some lifting force could be achieved, wherein a bucket angle is an additional parameter of the current bucket state.

2. The method according to claim 1, wherein a vehicle inclination angle is an additional parameter of the current bucket state.

3. The method according to claim 2, wherein the step of determining the LFES is determining the LFES by a pre-calculated table which contains the LFES for each bucket state.

4. The method according, to claim 2, wherein the step of determining the LFES is determining the LFES through interpolation from a pre-calculated table which contains the LFES for each bucket state in relation to a vehicle inclination angle.

5. The method according to claim 1, wherein the step of receiving the state input comprises the step of receiving the state input on the bucket angle obtained through at least one method of detecting the length of a tilt cylinder, detecting the angle of a link-arm related to the tilt cylinder, or directly measuring the bucket angle.

6. The method according to claim 1, wherein the step of determining the LFES is determining the LFES by solving in real time the equation on the relation between the current bucket state and the LFES.

7. The method according to claim 1, wherein the step of determining the LFES is determining the LFES by a pre-calculated table which contains the LFES for each bucket height.

8. The method according to claim 1, further comprising steps of recognizing whether the working machine is currently in a bucket filling phase and controlling the engine speed not to reach the LFES only when the working machine is currently in a bucket filling phase.

9. The method according to claim 8, wherein the current working state is recognized as the bucket filling phase when a mode switch is operated.

10. The method according to claim 8, wherein the current working state is recognized as the bucket filling phase using a pre-set standard for the state input including one or more of the standards of the bucket height, the bucket angle and the speed of the working machine.

11. The method according to claim 10, further comprising a step of releasing the control of the engine speed when a manual override switch is operated even when the engine speed is properly controlled during the bucket filling phase.

12. A method for controlling a working machine provided with a bucket as a work implement by which a lifting force can be exerted on an object such as a gravel pile, and at least one ground engaging element by which a traction force can be exerted on the same object, wherein the lifting force is an upward-directed lifting force experienced by the object, comprising:

receiving a state input indicative of a current bucket state, a bucket height being a parameter of the current bucket state, determining a lifting force eliminating speed of a power source (LFES) at the current bucket state, the LFES being the speed at and above which no lifting force could be achieved considering a reaction force acting on the bucket caused by the traction force, and controlling the speed of the power source not to reach the LFES in order that at least some lifting force could be achieved, wherein the step of receiving the state input comprises the step of receiving the state input on the bucket height obtained through at least one method of detecting the length of a lift cylinder, detecting the angle of a load arm, or directly measuring the bucket height.

13. An electronic control unit (ECU) adapted to perform a method for controlling a working machine provided with a bucket as a work implement by which a lifting force can be exerted on an object such as a gravel pile, and at least one ground engaging element by which a traction force can be exerted on the same object, wherein the lifting force is an upward-directed lifting force experienced by the object, the method comprising:

receiving a state input indicative of a current bucket state, a bucket height being a parameter of the current bucket state, determining a lifting force eliminating speed of a power source (LFES) at the current bucket state, the LFES being the speed at and above which no lifting force could be achieved considering a reaction force acting on the bucket caused by the traction force, and controlling the speed of the power source not to reach the LFES in order that at least some lifting force could be achieved, wherein a bucket angle is an additional of the current bucket state.

14. A vehicle control system comprising an electronic control unit (ECU) adapted to perform a method for controlling a working machine provided with a bucket as a work implement by which a lifting force can be exerted on an object such as a gravel pile, and at least one ground engaging element by which a traction force can be exerted on the same object, wherein the lifting force is an upward-directed lifting force experienced by the object, the method comprising:

receiving a state input indicative of a current bucket state, a bucket height being a parameter of the current bucket state, determining a lifting force eliminating speed of a power source (LFES) at the current bucket state, the LFES being the speed at and above which no lifting force could be achieved considering a reaction force acting on the bucket caused by the traction force, and controlling the speed of the power source not to reach the LFES in order that at least some lifting force could be achieved, wherein a bucket angle is an additional parameter of the current bucket state.

15. A working machine comprising a vehicle control system comprising an electronic control unit (ECU) adapted to perform a method for controlling a working machine provided with a bucket as a work implement by which a lifting force can be exerted on an object such as a gravel pile, and at least one ground engaging element by which a traction force can be exerted on the same object, wherein the lifting force is an upward-directed lifting force experienced by the object, the method comprising:

receiving a state input indicative of a current bucket state a bucket height being a parameter of the current bucket state, determining a lifting force eliminating speed of a power source (LFES) at the current bucket state, the LFES being the steed at and above which no lifting force could be achieved considering a reaction force acting on the bucket caused by the traction force, and controlling the speed of the power source not to reach the LFES in order that at least some lifting force could be achieved, wherein a bucket angle is an additional parameter of the current bucket state.

16. A method for controlling a working machine provided with a bucket as a work implement by which a lifting force can be exerted on an object such as a gravel pile, and at least one ground engaging element driven by one or a plurality of electric or hydrostatic wheel motors by which a traction force can be exerted on the same object, wherein the lifting force is an upward-directed lifting force experienced by the object, comprising:

receiving, a state input indicative of a current bucket state, a bucket height being a parameter of the current bucket state, determining a lifting force eliminating torque of the wheel motor(s) (LFET) at the current bucket state, the LFET being the torque at and above which no lifting force could be achieved considering a reaction force acting on the bucket caused by the traction force, and controlling the torque of the wheel motor(s) not to reach the LFET in order that at least some lifting force could be achieved, wherein a bucket angle is an additional parameter of the current bucket state.

17. The method according to claim 16, wherein a vehicle inclination angle is an additional parameter of the current bucket state.

18. A working machine comprising a vehicle control system comprising an electronic control unit (ECU) adapted to perform a method for controlling a working machine provided with a bucket as a work implement by which a lifting force can he exerted on an object such as a gravel pile, and at least one ground engaging element by which a traction force can be exerted on the same object, wherein the lifting force is an upward-directed lifting force experienced by the object, the method comprising:

receiving a state input indicative of a current bucket state, a bucket height being a parameter of the current bucket state, determining a lifting, force eliminating speed of a power source (LFES) at the current bucket state, the LFES being the speed at and above which no lifting force could be achieved considering a reaction force acting on the bucket caused by the traction force, and controlling the speed of the power source not to reach the LFES in order that at least some lifting force could be achieved, wherein the step of receiving the state input comprises the step of receiving the state input on the bucket height obtained through at least one method of detecting the length of a lift cylinder, detecting the angle of a load arm, or directly measuring the bucket height.

19. A method for controlling a working machine provided with a bucket as a work implement by which a lifting force can be excited on an object such as a gravel pile, and at least one ground engaging element driven by one or a plurality of electric or hydrostatic wheel motors by which a traction force can be exerted on the same object, wherein the lifting force is an upward-directed lifting force experienced by the object, comprising:

receiving a state input indicative of a current bucket state, a bucket height being a parameter of the current bucket state, determining a lifting force elumnating toique of the heel motor(s) (LFET) at the current bucket state, the LFET being the torque at and above which no lifting force could be achieved considering a reaction force acting on the bucket caused by the traction force, and controlling the torque of the wheel motor(s) not to reach the LFET in order that at least some lifting force could be achieved, wherein the step of receiving the state input comprises the step of receiving the state input on the bucket height obtained through at least one method of detecting the length of a lift cylinder, detecting the angle of a load arm, or directly measuring the bucket height.

* * * * *